US005992170A

United States Patent [19]

Yap

[11] Patent Number: 5,992,170

[45] Date of Patent: Nov. 30, 1999

[54] CYLINDER HEAD-SUCTION MUFFLER ASSEMBLY FOR HERMETIC COMPRESSOR

[75] Inventor: Wee Beng Yap, Singapore, Singapore

[73] Assignee: Matsuhita Refrigeration Industries (s) Pte Ltd, Singapore, Singapore

[21] Appl. No.: 09/117,419

[22] PCT Filed: Apr. 11, 1997

[86] PCT No.: PCT/SG97/00014

§ 371 Date: Jul. 29, 1998

§ 102(e) Date: Jul. 29, 1998

[87] PCT Pub. No.: WO97/41352

PCT Pub. Date: Nov. 6, 1997

[30] Foreign Application Priority Data

May 2, 1996 [SG] Singapore ..... 9609669-8

[51] Int. Cl.[6] ..... F04B 39/00

[52] U.S. Cl. ..... 62/296; 417/312; 188/229; 188/403

[58] Field of Search ..... 62/296; 181/229, 181/403; 417/312

[56] References Cited

U.S. PATENT DOCUMENTS 4,313,715 2/1982 Richardson, Jr. ..... 417/312
4,477,229 10/1984 Kropiwnicki et al. ..... 417/53
4,784,581 11/1988 Fritchman ..... 417/312
5,207,564 5/1993 Fritchman ..... 417/312
5,577,898 11/1996 Lee ..... 62/296

*Primary Examiner*—William E. Tapolcal
*Attorney, Agent, or Firm*—Lawrence Y. D. Ho; David D. Chung; Jacqueline C.T. Lui

[57] ABSTRACT

An improved cylinder head-suction muffler assembly includes a suction muffler (2), a cylinder head (1), a capillary tube (7) and a self-latching clip (5). The suction muffler (2), has a suction tube (3) with a mounting block (14) and a capillary tube holder (13), and the cylinder head (1) has a suction plenum (4) and an extended portion (6) with a pair of channels (10). The self-latching clip (5) is mounted on the mounting block (14) and in the channels (10) to secure the suction muffler (2) assembly to the cylinder head (1). The self-latching clip (5) has a narrow portion (9), a wide portion (11), and a pair of bent ends (12). To couple the suction muffler (2) to the cylinder head (1) the suction tube (3) is inserted into the suction plenum (4). The capillary tube (7) is positioned in the capillary tube holder (13) and the narrow portion (9) of the self-latching clip (5) is mounted on the mounting block (14) and over the capillary tube (7) and a wide portion (11) is placed in the channels (10). The clip (5) is pushed in until the bent ends (12) are outside of the channels (10), and the clip (5) is securely in place.

6 Claims, 2 Drawing Sheets

CYLINDER HEAD-SUCTION MUFFLER ASSEMBLY FOR HERMETIC COMPRESSOR

FIELD OF THE INVENTION

This invention relates to the field of compressors, and particularly to an improved coupling of cylinder head-suction muffler assembly in sealed reciprocating and rotary compressors for refrigeration and air conditioning.

BACKGROUND OF THE INVENTION

The function of sealed compressors for cooling fluids is well known in the art. Typically, an electric motor drive is built into a sealed housing or shell, and has a stator or electric armature affixed therein and a rotor assembly assembled into the cylindrical passage of the stator. This rotor assembly includes a rotor and a crankshaft which is inserted into the cylindrical passage of the rotor by interference fit. The reciprocating motion of the rotor and the piston in the compression chamber compresses low pressure gas into high pressure gas. The gas comprises typically freon or substitutes thereof. The low pressure gas comes from the closed loop system and enters a suction chamber through a cylinder head—suction muffler assembly. At the suction chamber, the low pressure gas is drawn into a compression chamber during the suction stroke of the reciprocating machine. A negative vacuum pressure is created. At the same time, lubricating fluid is also drawn into the suction chamber from a sump at the base of the crankshaft through a capillary tube for mixing with inert gas and lubricating the compression chamber. The compressed gas in the compression chamber is directed to the condenser of the system through a discharge valve, a discharge muffler, discharge line and tube discharge.

The prior art cylinder head-suction muffler assembly comprises a suction muffler, a capillary tube, a support plate, screws, and a cylinder head. The fabrication of the cylinder head requires at least one bore and two tightening holes to be made on the cylinder head. Similarly, the installation of the cylinder head to the suction muffler requires at least five steps: (1) inserting the suction tube of the suction muffler into the suction bore of the cylinder head, (2) fitting the capillary tube onto the suction muffler, (3) placing the support plate over the capillary tube and the two tightening holes, (4) inserting screws into the holes, and (5) tightening the screws. Because this assembly requires threaded fasteners, the prior art cylinder head-suction muffler assembly not only requires additional machining and handling, but the process of assembling it is time and labour intensive.

In an attempt to reduce the number of threaded fasteners and the time required for assembly, a few improvements have been made in the cylinder head-suction muffler assembly which are disclosed in, for instance, U.S. Pat. No. 5,207,564, and in European Patent Publication 195,486, where a screw-less specially-designed clips were used. However, the clips in these and other prior art assembly designs incorporated complex shapes and features. In addition, some of the designs required complicated locking features which needed precision in manufacturing of the parts and which required some effort to make and use. Because reduction in assembly time is a primary goal, it would be highly desirable to have components which are highly manufacturable in mass quantities, are easy to use, and are highly reliable.

SUMMARY OF THE INVENTION

Hence, it is the object of the present invention to provide a cylinder head-suction muffler assembly which minimizes the fabrication and installation process while providing a reliable coupling of the parts. The improved cylinder head-suction muffler assembly includes a suction muffler, a cylinder head, a capillary tube and a self-latching clip. The suction muffler has a suction tube with a mounting block and a capillary tube holder, and the cylinder head has a suction plenum and an extended portion with a pair of channels. A self-latching clip is mounted on the mounting block and a portion of it is placed in the channels to secure the suction muffler assembly to the cylinder head. The self-latching clip has a narrow portion, a wide portion, and a pair of bent ends. To couple the suction muffler to the cylinder head, the suction tube is inserted into the suction plenum. The capillary tube is positioned in the capillary tube holder, and the narrow portion of the self-latching clip is mounted on the mounting block and over the capillary tube, and a wide portion is placed in the channels. The clip is pushed in until the bent ends are outside of the channels, and the clip is securely in place.

DETAILED DESCRIPTION OF THE INVENTION

Figure 1A:
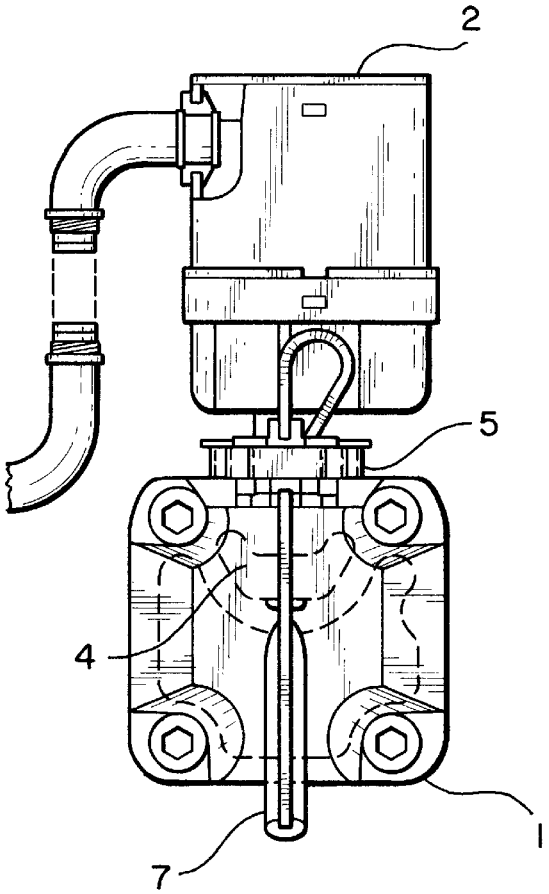
FIG. 1A is a front view of the cylinder head-suction muffler assembly.
Figure 1B:
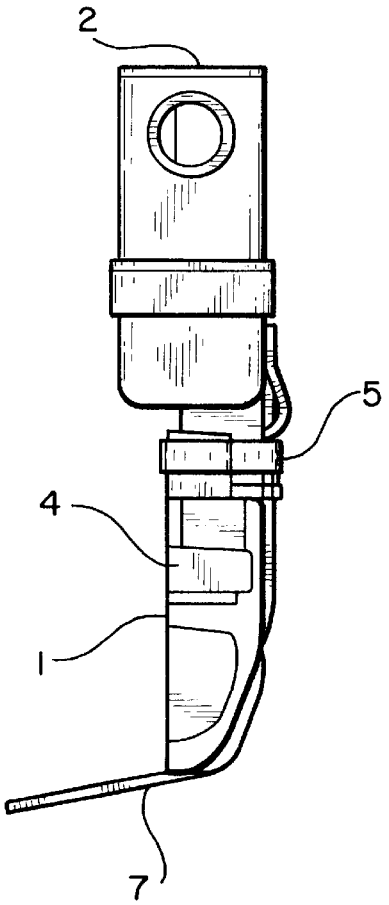
FIG. 1B is a side view of the cylinder head-suction muffler assembly.

FIGS. 1A through 2B illustrate the preferred embodiment of the present invention. The improved cylinder head-suction muffler assembly includes a discharge cylinder head 1, a suction muffler 2, a capillary tube 7 and a self-latching clip 5. As can be better seen in FIG. 2A and 2B, the cylinder head 1 includes a suction plenum 4 and an extended portion 6 which has a pair of pre-cast channels 10. The suction muffler 2 includes a suction tube 3 which is inserted into the suction plenum 4. The suction tube 3 has a mounting block 14 and a capillary tube holder 13 which holds the capillary tube 7 in place. The mounting block 14 is integrated with the suction tube 3 and the capillary tube holder 13, but is wider than the tube, and has substantially vertical side walls 14*a*.

The block 14 serves multiple functions. The block 14, being wider than the opening to the suction plenum 4, controls the depth of the suction tube insertion by preventing the tube from being inserted beyond the block. In addition, the width of the block 14 is such that it fits snugly into the opening of the extended portion 6, and the substantially vertical side walls 14*a* are adapted for fittingly receiving the self-latching clip 5. The clip 5 is placed over the mounting block 14 and around the extended portion 6 such that the clip 5 fits snugly in the channels 10. The capillary tube 7 is tightly fitted into the holder 13 and under the clip 5. The capillary tube holder 13 serves the dual function of holding the capillary tube 7 in place as well as preventing the suction tube 3 from slipping out from underneath the clip 13, and the capillary tube 7, besides performing its usual function, also serves to provide tension against the clip 5 to limit any excessive movement of the suction tube 3.

Figure 3:
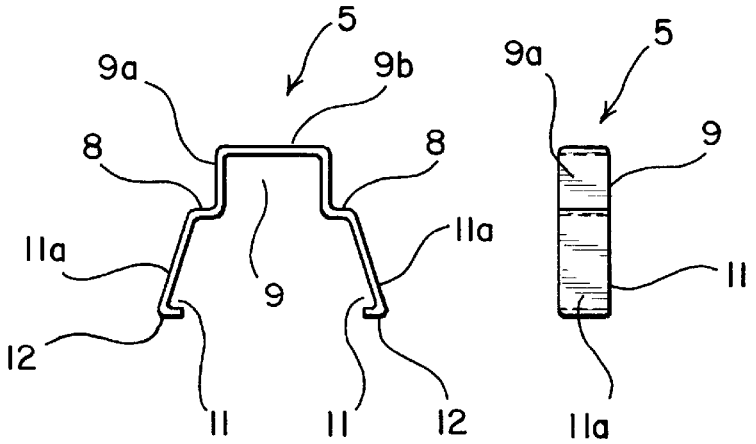
FIG. 3 is a front view and a side view of the self-latching clip.
Figure 2A:
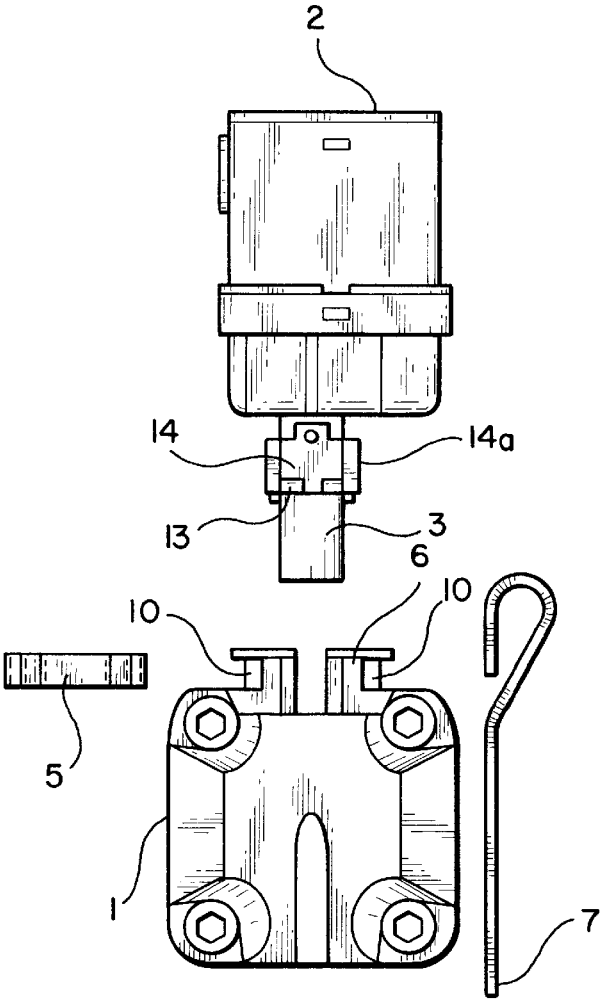
FIG. 2A is a front view of the assembly of FIG. 1A with the cylinder head, suction muffler, capillary tube, and self-latching clip removed.
Figure 2B:
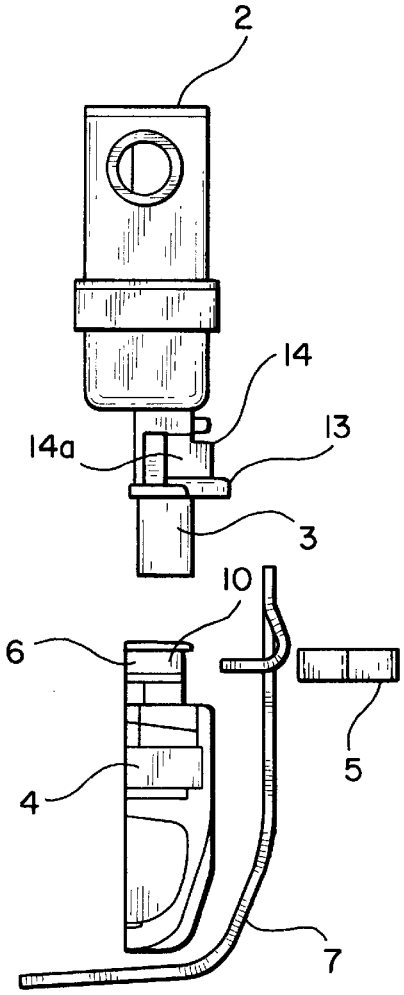
FIG. 2B is a front view of the assembly of FIG. 1B with the cylinder head, suction muffler, capillary tube, and self-latching clip removed.

FIG. 3 illustrates the preferred embodiment of the self-latching clip 5 in detail. The clip 5 includes a narrow portion 9, a wide portion 11, a shoulder 8, and a pair of bent ends 12. The narrow portion 9 is U-shaped with sides 9*a* which are substantially perpendicular to the top 9*b*. The width of the narrow portion 9 should be about that of the mounting block 14 and should fit snugly around the block side walls 14*a* such that the narrow portion 9 prevents the clip holder 13 from slipping underneath the clip 5. The wide portion 11 has slanting sides 11*a* which are of substantially the same slope as the channels 10 on the extended portion 6 of the cylinder head 1, and should fit snugly within the channels 10. The shoulder 8, while not completely necessary, allows the clip 5 to fit better in the proper places, and provides higher spring recoil force in the wider portion 11. The bent ends 12 help to prevent the clip 5 from being inadvertently disengaged from the assembly.

The clip 5 should be made of metal which will allow it have a some elasticity such that the clip 5 can be temporarily widened to be inserted into place without losing its original shape. This property allows it to be inserted into place very quickly. To insert, the clip 5 is widened slightly so that the bent ends 12 are fitted around the channels 10. A slight pushing force is exerted on the clip until the clip 5 snaps into place with the bent ends 12 are outside of and around the channels 10 and the wide portion 11 snug in the channels 10. Although some slight movement of the suction muffler 2 is tolerated, the muffler 2 one should not be able to easily disengage the suction tube 3 from the suction plenum 4 once the clip 5 is in its proper position.

This clip has a number of advantages over other existing clips. It does not require any threaded fasteners such as screws, and can be inserted into place extremely quickly and securely. In addition, the clip can be fabricated very quickly and easily due to its simple design. Hence, the clip shortens the fabrication time of the cylinder head-suction muffler assembly. Virtually any rectangular metal strip having sufficient elasticity can be bent into shape to form the clip. The clip can be made independent of the cylinder head and the suction muffler, and few modifications are needed in the current cylinder-head design to accommodate the clip.

It should be understood by those skilled in the art that although the preferred embodiment has been described here for the purposes of fully disclosing the way to make and use the invention, various modifications can be made without completely losing the effectiveness of the present invention. For instance, although the clip 5 has a shoulder 8, a slanting wide portion 11, and a U-shaped narrow portion 9, the shoulder may be eliminated. Also, the wide portion be U-shaped or the narrow portion be slanted. Various other combinations are also possible. In addition, although it is preferred that the capillary tube holder 13 act as the stopper to prevent the muffler tube from slipping out, any extending flap or flange may work just as well. Furthermore, although it is preferred that the capillary tube be placed under the self-latching clip, it may be placed outside of clip without significantly affecting the assembly. Hence, various modifications, additions and substitutions are possible for the invention described herein, without departing from the scope and spirit of the invention as disclosed in the accompanying claims.

I claim:

1. A cylinder head-suction muffler assembly in a compressor for compressing fluids, said assembly comprising:

a cylinder head having a suction plenum and an extended portion, said extended portion having a pair of channels;

a suction muffler having a suction tube, said suction tube disposed inside said suction plenum;

a mounting block integrated with said suction tube;

a capillary tube holder for holding a capillary tube; and a self-latching clip snugly fitted over said mounting block and fitted within said channels to prevent said suction muffler tube from being disengaged from said suction plenum without requiring a threaded fastener, said clip being made of an elastic material and having a general U-shape such that the clip can be temporarily widened to easily place the clip into position.

2. The assembly as claimed in claim 1 wherein said clip has a narrow portion, a wide portion, a shoulder, and bent ends.

3. The assembly as claimed in claim 2 wherein said narrow portion is U-shaped and has a top and sides with the sides being substantially perpendicular to said top.

4. The assembly as claimed in claim 3 wherein said wide portion has slanting sides.

5. The assembly according to claim 2 wherein said clip is a made from a flat rectangular metal strip.

6. The assembly according to claim 1 wherein said capillary tube is placed under the self-latching clip.

* * * * *